United States Patent [19]

Case

[11] Patent Number: 4,768,614

[45] Date of Patent: Sep. 6, 1988

[54] UNIDIRECTIONAL ENHANCER FOR MICROPHONES

[76] Inventor: Eliot M. Case, 1070 Bryan Ave., Salt Lake City, Utah 84105

[21] Appl. No.: 936,075

[22] Filed: Nov. 28, 1986

[51] Int. Cl.[4] ..... H04R 17/02

[52] U.S. Cl. ..... 181/148; 181/151; 181/158; 181/171; 381/91; 381/155; 381/158; 381/163; 381/169; 381/188; 381/205

[58] Field of Search ..... 181/148, 152-158, 181/171, 172, 189-199, 175, 178, 159; 367/118, 152; 381/87-92, 169, 205, 156, 158, 159, 163, 168, 188, 154, 155, 157

[56] References Cited

U.S. PATENT DOCUMENTS

| | | | |
|---|---|---|---|
| 967,217 | 8/1910 | Mattison | 381/168 |
| 1,396,402 | 11/1921 | Bristol | 181/198 X |
| 1,589,408 | 6/1926 | Maxfield | 181/148 |
| 1,732,722 | 10/1929 | Horn | 181/175 X |
| 1,789,104 | 1/1931 | Kuchenmeister | 381/156 |
| 2,228,886 | 1/1941 | Olson | 181/158 |
| 2,299,342 | 10/1942 | Olson | 181/175 X |
| 2,699,473 | 1/1955 | Kettler et al. | 181/158 X |
| 2,773,933 | 12/1956 | Hawley | 381/155 |
| 2,856,022 | 10/1958 | Kurtze et al. | 367/118 |
| 3,007,012 | 10/1961 | Olson | 381/155 |
| 3,095,484 | 6/1963 | Beaverson et al. | 181/158 X |
| 3,560,668 | 2/1971 | Warning | 181/158 X |
| 4,258,235 | 3/1981 | Watson | 381/155 |

*Primary Examiner*—Benjamin R. Fuller

*Attorney, Agent, or Firm*—Arthur G. Yeager; Earl L. Tyner

[57] ABSTRACT

A hollow enclosure that suspends a bidirectional microphone element within, in such a fashion as to improve the unidirectional characteristics, of said bidirectional microphone.

5 Claims, 1 Drawing Sheet

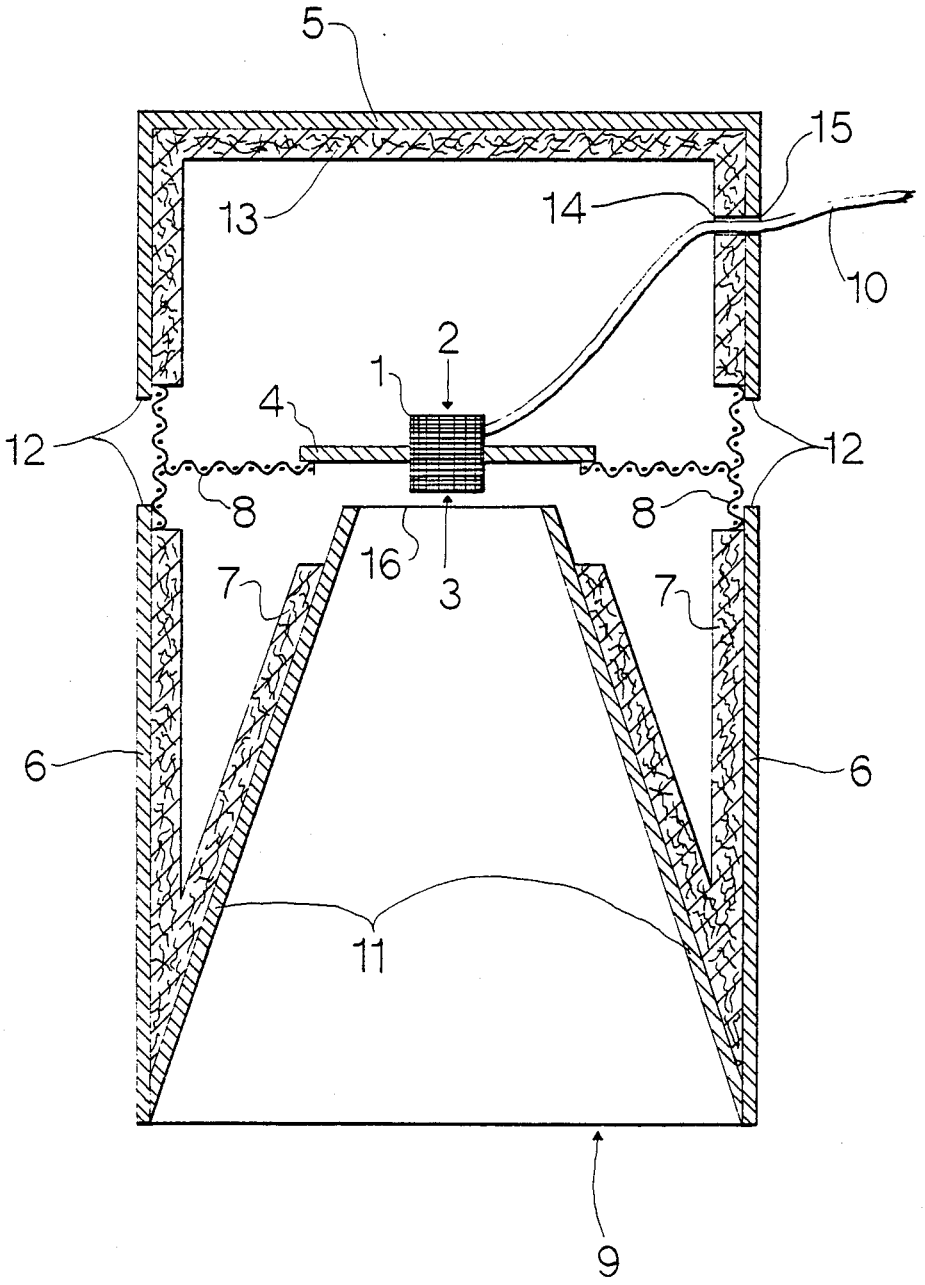
5
15
13
14
10
2
1
4
12
12
8
8
16
3
7
7
6
6
11
9

UNIDIRECTIONAL ENHANCER FOR MICROPHONES

BACKGROUND OF THE INVENTION

In many communication, entertainment and surveillance industries a very selective electro acoustic pickup of distant sound on a highly unidirectional basis while also substantially rejecting all other sounds from all other directions is needed.

Two main types of microphones attempt to obtain the above mentioned requirements and are commonly used in the above mentioned industries. These are the transmission line and the parabolic reflector. Both of these microphones are actually a form of enhancing the pickup pattern of a cardiod, hypercardiod, or some other public domain basic microphone design concept.

In the transmission line designs sound coming from directions other than the one desired are not completely cancelled but are received from many various smaller side and or rear lobes. Reception of undesired sound through side or rear lobes not only effects the overall directivity of the device, but in most cases effects the low frequency to high frequency ratio of these extraneous sounds, making these sounds spectrally distorted. Each side and or rear lobe having a somewhat different frequency response and a zone of very low sensitivity between the adjacent side lobes and cause large unwanted changes in the undesired sound recepted, when the microphone is moved to follow a moving sound source.

In the parabolic reflector type of microphone, the ability of directivity is directly proportional to the size of the reflector. In most cases, a reflector large enough to have a good directivity in the low frequency audio range will be so physically large as to make its use limited. Smaller more portable reflectors generally have insufficient low frequency response to be used in wide frequency response audio applications.

No known prior art unidirectional microphone design can produce maximum rejection of recepted sound from the rear of the microphone and the sides of the microphone and all angles inbetween the rear and sides of the microphone in a uniform fashion over a wide frequency band.

SUMMARY OF THE INVENTION

This invention pertains to a new type of hollow enclosure that suspends a bidirectional microphone element within, in such a way as to center said bidirectional microphone respectively in two vents connecting the inside of the enclosure to the environment on the outside of the enclosure.

The general object of this invention is to use the basic properties of common bidirectional microphones having two lobes of pickup in a new type of enclosure to produce an improved unidirectional microphone with one front lobe of pickup and no side or rear lobes. All sound received by this one lobe will have good low frequency to high frequency ratio. All sound not received through this one lobe shall have a greatly reduced level, but shall maintain a good low frequency to high frequency ratio.

This invention incorporates and improves upon the directional characteristics of any bidirectional microphone, placed properly in this new type of unidirectional enhancer.

BRIEF DESCRIPTION OF THE DRAWING

The accompanying drawing is a cross sectional view illustrating an embodiment of this invention.

DETAILED DESCRIPTION OF THE DRAWING

In the drawing reference numerals 5, 6, 8 and 11 combine to form a rigid cylindrical enclosure with a conical entrance vent 9 at one end and a side entrance vent 12 formed by the spacing of casing elements 5 and 6 running the circumference.

4, 5, 6 and 11 for example, are composed of aluminum or a similar solid material which will prevent the passage of sound. 8 is composed, for example, of a rigid aluminum screen which will allow entrance of sound into the enclosure and to either side of isolation plate 4 by means of multiple passages through said screen.

The screen 8 is connected to 4, 5 and 6 by overlaps. An adhesive substance or a weld bonding the overlap of 4 and 8 hold these parts in a fixed position.

An adhesive substance or weld bonding the overlap of 5 and 8 hold these parts in a fixed position.

Friction, an adhesive substance, or a weld at the overlap of 6 and 8 hold these parts in a fixed position. In the case of a friction fit at the junction of 6 and 8 the enclosure elements 6, 11 and 7 may be removed for lower directivity of the assembly.

An adhesive substance or weld, bonding the junction of 6 and 11 hold these parts in a fixed position.

The horn 11 has a hollow passage through a large cross sectional area at the large diameter forming vent 9 to a smaller cross sectional area at the small diameter 16 projecting into the enclosure towards and in spaced relation to plate 4.

The plate 4 is circular and suspended coaxially within the enclosure in such a fashion as to place the plane of 4 bisecting side vent 12. The cross sectional area of 4 is greater than the cross sectional area of 16. The spacing of 4 to 16 is approximately one-half the distance between 5 and 6.

The bidirectional microphone element 1 in this embodiment consists of the entire outer casing of 1 being composed of a rigid acoustically transparent screen in the form of a cylinder. The bidirectional microphone 1 in this embodiment is an acoustic transducer operating on a pressure gradient principal, but may be a hydroacoustic transducer if this invention were to be used in a liquid medium such as water. The bidirectional microphone 1 is responsive to the difference of pressure exerted on opposite sides of said bidirectional microphone, the opposing sides being 2 and 3 thereby making 2 and 3 the two directions of resultant sensitivity of 1. 1 may be one of many common designs or a design currently patented, patent pending, or a future invention. The basic properties of a bidirectional microphone used as 1 are not novel and thus any microphone or combination of microphones being described as having two lobes of reception 180 degrees apart and a plane of cancellation 90 degrees perpendicular to both lobes shall be acceptable as 1, if oriented as specified further in the specification within the enclosure formed by 4, 5, 6, 8 and 11.

The bidirectional microphone 1 is centrally suspended through a hole in plate 4 in such a fashion that the plane of greatest cancellation shall be placed in the same plane as 4. For best operation of the complete assembly the mounting of 1 in plate 4 should totally isolate the acoustic passage from side 3 of 1 to side 2 of 1 within the circumference of 4.

In this embodiment, 1 is bonded to 4 by an adhesive substance at the junction of 1 and 4.

7 and 13 are an acoustic dampening material such as a thick cloth to prevent higher frequencies from resonating within the enclosure.

5 is bonded by an adhesive substance to 13 at the junction of 5 and 13 to hold 13 in a fixed position.

7 is bonded by an adhesive substance to 6 at the junction of 7 and 6 to hold these parts in fixed position.

Vent 9 is the front of the enclosure.

Element 5 is the rear of the enclosure.

The only resultant lobe of sensitivity will be received through vent 9 through the horn 11 through 16 to side 3 of 1 increasing the pressure level received at 3 of 1. All sound not received directly through 9 and 11 and 16 to 3, shall be received through the side vent 12 through 8. Sound received through the side vent 12 through 8 shall be received in equal proportions by 2 and 3 of 1, causing cancellation and low electrical output of 1 resulting in no rear or side lobes of sensitivity, as compared to a high electrical output of 1 from a sound entering through 9. By means of the basic operation of 1 in plate 4, sound entering through vent 12 by the spacing of 5 and 6 shall be such as to cancel all frequencies below and including the highest frequency wave in the frequency band of which the entire assembly is to be operated.

Enclosure elements 6, 11 and 7, if totally removed from the assembly by means of the junction of 8 and 6, will effectively connect vents 9 and 12, rendering the entire assembly at the worst case unidirectional condition, rejecting approximately five sixths of all sound recepted. The improvement of unidirectionality over the above mentioned worst case is directly proportional to the distance between 9 and 16, when 6, 11 and 7 are connected as illustrated.

10 is a means of conducting the output of 1 to the outside of the enclosure. In this embodiment, a twisted shielded pair of insulated wires. A hole 14 is punched or drilled through 13, slightly larger in diameter than the diameter of 10. A hole 15 is punched or drilled through 5 slightly larger in diameter than the diameter of 10. The centering of 14 and 15 is such as to allow the passage of 10 from the inside of the enclosure to the outside of the enclosure through 14 and 15. The clearance of 10 through 15 should not be made large enough to effect proper operation of the entire assembly.

While the invention has been described with respect to the details of a specific embodiment thereof, many changes and variations will be apparent to those skilled in the art, and such can obviously be made without departing from the scope of the invention.

Having described the invention, what is claimed is:

1. A unidirectional enhancer for microphones comprising:

a hollow enclosure defined by sides, a closed end, and an open end; said open end being a first vent for receiving sound flow therethrough when said open end is pointed at a source of the sound; a second vent being a passageway through said sides and extending completely around said enclosure and being adapted to receive sound therethrough;

means for suspending a bidirectional microphone within said enclosure;

said bidirectional microphone being responsive to a difference in pressures exerted on opposite sides of said bidirectional microphone;

said means for suspending said bidirectional microphone within said enclosure allowing acoustic passage through said first vent to one side of said bidirectional microphone, said first vent not impeding sound entering through said second vent from reaching both sides of said bidirectional microphone;

said means for suspending said bidirectional microphone within said enclosure allowing free acoustic passage through said second vent of said enclosure equally to both sides of said bidirectional microphone, while not impeding the flow of sound around said bidirectional microphone;

sound entering said first vent producing an output from said bidirectional microphone, sound entering said second vent producing a minimal output from said bidirectional microphone;

said enclosure with said bidirectional microphone suspended therein having one unidirectional lobe of sensitivity and no side or rear lobes of sensitivity;

means for conducting a signal generated or induced by the reception of sound at said bidirectional microphone to the outside of said enclosure; and means within said enclosure for dampening reflections of sound of higher frequency than that which said enclosure is adapted to receive.

2. The unidirectional microphone enchancer according to claim 1, wherein said second vent is composed of a plurality of passageways.

3. The unidirectional enhancer for microphones according to claim 1, wherein said enclosure is cylindrical.

4. The unidirectional enhancer for microphones according to claim 1, wherein all sounds entering said second vent below the highest frequency wave in a frequency band for which the enchancer is to be operated to produce a minimal output from said bidirectional microphone.

5. The unidirectional enhancer of claim 4, wherein said enclosure is cylindrical.

* * * * *